US012351921B2

(12) United States Patent
Gleissner et al.

(10) Patent No.: US 12,351,921 B2
(45) Date of Patent: Jul. 8, 2025

(54) DISTRIBUTION BODY FOR A PROCESS FLUID FOR CHEMICAL AND/OR ELECTROLYTIC SURFACE TREATMENT OF A SUBSTRATE

(71) Applicant: SEMSYSCO GMBH, Salzburg (AT)

(72) Inventors: Andreas Gleissner, Döbriach (AT); Philipp Engesser, Villach (AT); Harald Okorn-Schmidt, Klagenfurt (AT)

(73) Assignee: SEMSYSCO GMBH, Salzburg (AT)

( * ) Notice: Subject to any disclaimer, the term of this patent is extended or adjusted under 35 U.S.C. 154(b) by 232 days.

(21) Appl. No.: 17/778,745

(22) PCT Filed: Nov. 18, 2020

(86) PCT No.: PCT/EP2020/082542

§ 371 (c)(1),
(2) Date: May 20, 2022

(87) PCT Pub. No.: WO2021/099389

PCT Pub. Date: May 27, 2021

(65) Prior Publication Data

US 2023/0026551 A1 Jan. 26, 2023

(30) Foreign Application Priority Data

Nov. 22, 2019 (EP) ..... 19211049

(51) Int. Cl.
*C23F 1/08* (2006.01)
*C25D 5/08* (2006.01)
(Continued)

(52) U.S. Cl.
CPC ..... *C23F 1/08* (2013.01); *C25D 5/08* (2013.01); *C25D 7/12* (2013.01); *C25D 17/00* (2013.01); *C25D 21/10* (2013.01)

(58) Field of Classification Search
CPC ..... C25D 7/12–123; C25D 17/001; H01L 21/2885; H01L 21/76873; H01L 2224/11462
See application file for complete search history.

(56) References Cited

U.S. PATENT DOCUMENTS

2002/0191483 A1* 12/2002 Ohtsuki ..... B01F 25/431 366/107
2004/0065540 A1* 4/2004 Mayer ..... H01L 21/32134 257/E21.309

(Continued)

FOREIGN PATENT DOCUMENTS

CN 105821455 B 8/2018
CN 109306474 A 2/2019

(Continued)

OTHER PUBLICATIONS

Dietrich et al., Original and Machine Translation, DE 10 2010 033 256 A1 (Year: 2012).*

(Continued)

*Primary Examiner* — Hosung Chung
(74) *Attorney, Agent, or Firm* — Meunier Carlin & Curfman LLC

(57) ABSTRACT

The invention relates to a distribution body for a process fluid for chemical and/or electrolytic surface treatment of a substrate, a distribution system for chemical and/or electrolytic surface treatment of a substrate in a process fluid, a use of a distribution body or a distribution system for a chemical and/or electrolytic surface treatment of a substrate in a process fluid and a distribution method for a process fluid for chemical and/or electrolytic surface treatment of a substrate. The distribution body comprises: a front face, a rear face, at least an inlet, an outlet array, and a flow control array. The front face is configured to be directed towards the substrate for the surface treatment of the substrate. The rear face is (Continued)

arranged opposite to the front face. The inlet is configured for an entry of the process fluid into the distribution body. The outlet array comprises several outlets, which are configured for an exit of the process fluid out of the distribution body and towards the substrate. The flow control array is arranged upstream of the outlet array with respect to a flow of the process fluid and comprises several flow control elements.

21 Claims, 2 Drawing Sheets

(51) Int. Cl.

| | |
|---|---|
| ***C25D 7/12*** | (2006.01) |
| ***C25D 17/00*** | (2006.01) |
| ***C25D 21/10*** | (2006.01) |

(56) References Cited

U.S. PATENT DOCUMENTS

| | | | | |
|---|---|---|---|---|
| 2004/0121454 | A1* | 6/2004 | Jury | B01F 25/433 435/288.5 |
| 2009/0272644 | A1 | 11/2009 | Lukkarila et al. | |
| 2013/0186852 | A1 | 7/2013 | Dietrich et al. | |
| 2016/0194776 | A1* | 7/2016 | Weinhold | C25D 17/06 205/137 |
| 2017/0370017 | A1* | 12/2017 | Keigler | C25D 17/001 |

FOREIGN PATENT DOCUMENTS

| | | | |
|---|---|---|---|
| CN | 109309034 | A | 2/2019 |
| EP | 3498891 | A1 | 6/2019 |
| JP | 2002115096 | A | 4/2002 |

OTHER PUBLICATIONS

The Engineering Toolbox, Hydraulic Diameter (Year: 2017).*
English Translation of the Office Action in Taiwanese Application No. 110115823, mailed Mar. 17, 2022, 3 pages.
Office Action in EP Application No. 19211049.2, mailed on Jan. 25, 2022, 8 pages.
Office Action in EP Application No. 19211049.2, mailed on Aug. 10, 2022, 4 pages.
Office Action and English Translation issued in JP Application No. 2022-520136, mailed on Jan. 10, 2023, 5 pages.
Office Action and English translation thereof, issued in corresponding Korean application No. 10-2022-7010976, on Feb. 16, 2024, 10 pages.
Office Action issued on Dec. 1, 2023, in Singaporean Patent Application No. 11202201589U.
International Search Report and Written Opinion in Application No. PCT/EP2020/082542, mailed on Feb. 12, 2021, 8 pages.
Office Action in EP Application No. 19211049.2, mailed on Oct. 28, 2020, 6 pages.
Office Action in EP Application No. 19211049.2, mailed on Feb. 1, 2021, 5 pages.
Office Action in EP Application No. 19211049.2, mailed on Jul. 22, 2021, 4 pages.
Extended European Search Report in EP Application No. 19211049.2, mailed on May 28, 2020, 8 pages.
Office Action received in connection with CN Application No. 2020800753160, dated May 29, 2024, 18 pages.

* cited by examiner

DISTRIBUTION BODY FOR A PROCESS FLUID FOR CHEMICAL AND/OR ELECTROLYTIC SURFACE TREATMENT OF A SUBSTRATE

FIELD OF INVENTION

The invention relates to a distribution body for a process fluid for chemical and/or electrolytic surface treatment of a substrate, a distribution system for chemical and/or electrolytic surface treatment of a substrate in a process fluid, a use of a distribution body or a distribution system for a chemical and/or electrolytic surface treatment of a substrate in a process fluid, and a distribution method for a process fluid for chemical and/or electrolytic surface treatment of a substrate.

BACKGROUND OF THE INVENTION

Substrate dimensions of panels for producing large substrates as display panels or printed circuit boards (PCBs) are undergoing significant increases in their dimensions in order to increase manufacturing efficiency as well as to accommodate large size technology requirements.

The best processing results are achieved today with so-called HSP systems, meaning systems containing High Speed Plating technology. In such a system, one or two HSPs together with one or two substrates are immersed into a tank containing an electrolyte and one or several anodes. Within this tank filled with electrolyte, the electrolyte (and with this the current distribution) is directed through the HSP plate(s) towards the substrate surface(s).

Uniform electroplating using HSP systems requires that a high uniform flow field over the complete active area of the panel can be established and controlled. The active area is the space where the process on the substrate is targeted to happen, e.g. copper (or another metal) deposition with very high spatial uniformity. With the panels to be plated getting bigger also the HSP needs to scale up. The two main scaling-challenges associated with the larger dimensions are a horizontal flow and/or current distribution of the electrolyte and a vertical flow and/or current distribution.

Vertical non-uniformity means that, within the first centimeters of the active area of the HSP, the flow-speed out of the jet holes is usually significantly higher compared to the other jet holes distributed over the residual length of the HSP system, with a sharp transition of the flow-speed between the first centimeters (high-flow-speed part) and the rest of the HSP (lower-flow-speed part).

Horizontal non-uniformity is caused by the relative position of the electrolyte supply distribution inlets to the jet holes of the HSP. Jet holes located on top or relatively close to the supply inlet provide for higher flow electrolyte speeds than jet holes being located in-between the supply inlets.

In the prior art, the problem of non-uniform plating through non-uniform electrolyte and/or current distribution over the substrate surface has been mitigated by the implementation of a so-called baffle plate (or multiples thereof) to reduce the non-uniform flow distribution. However, the installation of a baffle plate has only provided limited success, in particular for large scale systems.

A baffle plate achieves better uniformity by restraining the flow of the electrolyte in higher flow-speed areas of the fluid and with this reduce significantly the electrolytic plating speed in general, as less electrolyte per unit time reaches the substrate. A baffle plate is also only applicable to mitigate horizontal non-uniformity issues. Vertical non-uniformity challenges cannot be addressed in this way and therefore vertical plating systems continue to have significant challenges. Therefore, the overall non-uniformity problem is not yet fundamentally solved.

SUMMARY OF THE INVENTION

Hence, there may be a need to provide an improved distribution body for a process fluid for chemical and/or electrolytic surface treatment of a substrate, which allows increasing the plating uniformity.

This problem is solved by the subject-matters of the independent claims, wherein further embodiments are incorporated in the dependent claims. It should be noted that the aspects of the invention described in the following apply also to the a distribution body for a process fluid for chemical and/or electrolytic surface treatment of a substrate, a distribution system for chemical and/or electrolytic surface treatment of a substrate in a process fluid, a use of a distribution body or a distribution system for a chemical and/or electrolytic surface treatment of a substrate in a process fluid and a distribution method for a process fluid for chemical and/or electrolytic surface treatment of a substrate.

According to the present invention, a distribution body for a process fluid for chemical and/or electrolytic surface treatment of a substrate is presented. The distribution body comprises: a front face, a rear face, at least an inlet, an outlet array, and a flow control array. The front face is configured to be directed towards the substrate for the surface treatment of the substrate. The rear face is arranged opposite to the front face. The inlet is configured for an entry of the process fluid into the distribution body. The outlet array comprises several outlets, which are configured for an exit of the process fluid out of the distribution body and towards the substrate. The flow control array is arranged upstream of the outlet array with respect to a flow of the process fluid and comprises several flow control elements.

The arrangement of several flow control elements upstream of the outlet array allows equilibrating the flow of electrolyte towards the jet holes. The surprising result is, that by placing the flow control elements in specific arrangements, an optimally uniform distribution of the liquid flow within the HSP in horizontal and vertical direction can be obtained and the special requirement for the arrangement of the flow control elements can be minimized. The optimally uniform flow distribution leads to an optimally uniform plating process and plating result on the substrate. The arrangement of several flow control elements upstream of the outlet array allows the flow equilibration even without significantly reducing the overall flow speed of the electrolyte.

The arrangement of several flow control elements upstream of the outlet array allows equilibrating the flow of electrolyte towards the jet holes. This flow equilibration is achieved by eliminating laminar flow areas. In an embodiment, the flow control elements are therefore arranged in a pattern to achieve a turbulent flow of the process fluid towards the outlet array. In fluid dynamics, turbulence or turbulent flow is fluid motion characterized by chaotic changes in pressure and flow velocity. It is in contrast to a laminar flow, which occurs when a fluid flows in parallel layers, with no disruption between those layers. In turbulent flow, unsteady vortices appear of many sizes, which interact with each other.

In an embodiment, the flow control elements are arranged in a pattern to achieve Reynolds numbers of at least 5000 in the process fluid. The Reynolds number is the ratio between the inertial forces in a fluid and the viscous forces. A fluid in motion tends to behave as sheets or layers of infinitely small thicknesses (smaller than the wavelength of light) sliding relative to each other. The viscosity of a fluid is the resistance to flow, which in turn translates as resistance to shear between the layers. The inertia (momentum) of the fluid is a dynamic function of its mass and speed, or resistance to a change in motion, which works to create shear between the fluid layers. This shear is created as a fluid encounters viscous resistance from an outside obstacle, such as the inner wall of a pipe, where flow is slowed by drag against the surface while remaining mostly unimpeded near the center of the pipe. For any given fluid, as flow rate increases, at a certain point the inertial forces begin to overcome the viscous forces; the smoothly-sliding layers of the fluid begin to roll past each other, and rough, turbulent flow results. The flow control elements may also be arranged in a pattern to achieve Reynolds numbers of at least 4000 or at least 6000 in the process fluid.

The pattern mentioned above in view of the turbulent flow and the Reynolds numbers can comprise (when seen in a flow direction of the fluid) a first row of flow control elements of a first size, first shape and/or arranged with a first distance relative to each other and at least a second row of flow control elements of a second size, second shape and/or arranged with a second distance relative to each other. The row can be understood to extend essentially perpendicular to the flow direction of the fluid. The row can be understood to comprise several flow control elements of the same kind (size, shape and/or distance) when seen in the fluid flow direction. The first sizes, shapes and/or distances are different to the second sizes, shapes and/or distances. Preferably, the first size and/or distance may be larger than the second size and/or distance. Of course, it can be the other way round. Adjacent flow control members are preferably displaced relative to each other and not aligned with each other. Of course, there can be a third or more rows of flow control elements differing from their adjacent row(s) or all rows. Of course, there can be also arrangements in columns in the direction of the fluid flow or arrangements with flow control elements of same size and shape.

In an embodiment, at least some of the flow control elements (when seen in a cross section of the distribution body) extend between the front face and the rear face and are in contact with the front face and the rear face. They can be called continuous flow control elements. In an embodiment, at least some of the flow control elements are pillar or rod shaped.

In another embodiment, at least some of the flow control elements are in contact with the front face and the rear face, but do not extend between the front face and the rear face. They comprise a first component arranged at the front face and a second component arranged at the rear face, however, the first and the second component are separate from each other and do not meet or contact each other. The flow control element can be called discontinuous. The first and the second components can be shaped, for example, as triangles or hemispheres. The first and the second components and in particular their central axes can be directed towards another and are aligned with each other. The first and the second components and in particular their central axes can also be displaced relative to each other. In all cases, the first and the second components may have the same shape and/or size or can be different.

In another embodiment, at least some of the flow control elements extend between the front face and the rear face and are only in contact with one of the front face or the rear face. In other words, there is only one component per flow control element, which touches only one face, but does not reach the other face. In an embodiment, at least some of the flow control elements are shaped as stalactites or stalagmites. A stalactite is a tapering structure hanging like an icicle from the roof of a cave. Therefore, a flow control element shaped as stalactite corresponds to a hanging, downward tapering structure. A stalagmite is a mound or tapering column from the floor of a cave. Therefore, a flow control element shaped as stalagmite corresponds to a mound structure tapering upwards.

In an embodiment, at least some of the several flow control elements have different sizes. In particular, at least some of the several flow control elements have different diameters relative to each other. In another embodiment, the flow control elements are of equal size.

In an embodiment, the flow control elements are arranged with equal distances to each other.

In another embodiment, at least some of the several flow control elements are arranged with different distances to each other. The different distances to each other may be implemented depending on the position of the individual flow control element relative to the inlet(s) into the distribution body. By varying the sizes or volumes of the flow control elements and/or their respective positions to each other, a still more uniform distribution of the liquid flow within the HSP in horizontal and vertical direction can be obtained. The uniform distribution leads to a very uniform plating process and plating result on the substrate. By implementing and positioning varying and non-equally spaced flow control elements (varying sizes/volumes and/or distances to each other), the space required for these flow control elements to obtain a uniform flow distribution, can be significantly reduced relative to the space required for equally spaced and equally sized flow control elements. The reduced space results in a significant reduction of the size of the HSP, its weight, and the material costs for production of the HSP.

In an embodiment, at least some of the flow control elements have a constant cross-section along their length. They might be shaped as pillars or rods. In another embodiment, at least some of the flow control elements have a cross-section of varying size along the length of the flow control elements. At least some of the flow control elements may have a longitudinal cross section in shape of pyramids, cones, double cones, triangles, polygons, balls, hemispheres, hourglasses, waves or the like.

In an embodiment, at least some of the flow control elements are massive. In another embodiment, at least some of the flow control elements comprise holes and in particular through holes to allow a flow of fluid through the flow control elements. In other words, the flow control elements are not fully massive.

In an embodiment, at least some of the flow control elements have a patterned surface, in particular a golf ball kind of surface. The patterned surface may have a Re value of at least 5000. A golf ball kind of surface describes a surface having dimples or indentations. The pattern may consist of regularly or irregularly spaced indentations, wherein the indentations may have the same size or different sizes.

Of course, all kinds of flow control elements can be mixed. Preferably, the distribution body comprises exactly or at least two different kinds of flow control elements, which means flow control elements, which differ in view of their (cross sectional) size, shape and/or distance. More preferably, the distribution body comprises two different kinds of flow control elements, which differ in view of their (cross sectional) size, which means a group of larger flow control elements and a grow of smaller flow control elements. The larger flow control elements are arranged closed to the inlet, the smaller flow control elements are arranged closer to the outlet for the process fluid. As such, a nearly optimally uniform distribution of the liquid flow within the HSP in horizontal and vertical direction can be obtained. The optimally uniform distribution leads to an optimally uniform plating process and plating result on the substrate. Further, the space required for these flow control elements is significantly reduced, which leads to a significant reduction of size, weight, and material cost of the distribution body.

The flow control array can be optimized to a fixed build size (in one dimension), which does not have to be scaled (in this one dimension) with the distribution body to be able to plate larger panels. The fixed build size of the distribution body may be in a range of 1 and 10 cm, more preferably in the range of 2 and 7 cm and most preferably in the range of 3 and 5 cm (in one direction). This might be the shortest build size to achieve a turbulent flow before the process fluid reaches the outlet array.

According to the present invention, also a distribution system for chemical and/or electrolytic surface treatment of a substrate in a process fluid is presented. The distribution system for chemical and/or electrolytic surface treatment of a substrate in a process fluid comprises a distribution body as described above and a substrate holder. The substrate holder is configured to hold at least one substrate relative to an outlet array of the distribution body.

An optional embodiment of the distribution system and the distribution body is described in the following in more detail.

The distribution system is intended for producing targeted flow and current density patterns for a chemical and/or electrolytic surface treatment and comprises the distribution body that is submerged in a fluidic process solution. Opposite of the flow distribution body is a substrate that is attached in a suitable mount, the surface of which is wetted by the process solution, and in case of an electrolytic treatment, an electrode body is present, which is preferably located on a side of the flow distribution body opposite of the substrate, and which is also bathed in the process solution.

The flow distribution body has a front face and a rear face positioned opposite of the front face, wherein the front face faces the substrate during the surface treatment, and the distance between the front face and the substrate surface to be processed is as constant as possible across the entire surface. For this purpose, the distance may be between sub-millimeters to a few centimeters. Furthermore, this body has at least one inlet opening for the process solution, and at least one optional liquid passage ending at the front face in at least one outlet opening or nozzle. The pumped process solution flows through this at least one outlet opening at a relatively high speed in the direction of the substrate, and enables the desired reaction at that location.

For discharging the process solution on the rear face of the flow distribution body, at least one connecting passage, preferably multiple connecting passages, may be provided, which guide the process liquid from the front face to the rear face of the body, and thus enable a cycle of the process solution, in that the solution may be re-pumped from here into the inlet opening.

The planar distribution of the at least one outlet opening may approximately correspond to a distribution of surface elements reacting on the substrate, which define a structure to be displayed such that, for example, an outlet opening is in approximate alignment with a surface element. The term "approximately" shall comprise both a deviation of the position of the surface element of the structure to be displayed from the position of the outlet opening by up to a diameter, or a width of the outlet opening, which is also called a lateral offset, and a deviation of a size of the outlet opening from a size of the surface element forming structure to be displayed. In the latter case, the outlet opening may be up to one order of magnitude larger than the corresponding, approximately aligned surface element. The term "approximately" shall also comprise an arrangement of multiple adjacent outlet openings in a grid that is narrowed as opposed to the arrangement of the remaining outlet openings, in order to flow to a corresponding, larger surface element of the substrate that is approximately in alignment with these outlet openings. With the selected arrangement it is therefore ensured that with an adequately high flow speed, a homogenous incoming flow into the regions to be processed is achieved.

In an advantageous manner, the arrangement of the connecting passage approximately corresponds with the structure to be displayed on the substrate such that in a particularly preferred manner the connecting passages are adjacent to the outlet openings in a multitude of such passages. This arrangement brings about a direct backflow of the process solution after the chemical or electrolytic reaction. The direct backflow may allow preventing a change of the flow distribution, particularly of the process fluid being discharged from the jet holes, between the front face of the distribution body and the substrate, thereby maintaining the uniform flow distribution leading to an optimally uniform plating process and plating result on the substrate. Furthermore, a targeted guidance of the electric field on the reacting surface regions may be achieved. For this purpose, the term "approximately" shall be defined for the connecting passage as above with reference to the outlet opening.

The substrate may be an essentially plate-shaped workpiece for the production of electric or electronic components, which is mechanically fixed in a mount, and the surface of which to be treated is bathed in the process liquid as the treatment medium coming from the flow distribution body. In a special case, the substrate may be a masked or unmasked conductor plate, a semi-conductor substrate, or a film substrate, or even any metal or metallized workpiece having an approximately planar surface. An approximately planar surface shall be defined herein such that a height difference between elevations and recesses of the substrate surface of the plate-shaped substrate are as large as the distance between the substrate and the flow distribution body, at a maximum.

The flow distribution body is advantageously embodied in multiple pieces, preferably in two pieces. In this manner, individual components of the flow distribution body may be simply exchanged such that different incoming or outgoing flows may be adjusted. The flow distribution body can also be embodied in just one piece.

A convection chamber positioned between the front face of the flow distribution body and the substrate surface is laterally limited in an advantageous manner by means of a solid wall (e.g. made from plastic material) in order to force a targeted back flow of the process solution through the flow distribution body, and to bundle the effect of an electric field optionally applied in the convection chamber.

An advantageous further development provides that in case of an electrochemical surface treatment a space positioned between the rear face of the flow distribution body and the counter electrode, being filled with the process liquid, is also laterally limited by a further solid wall (e.g. made from plastic material) in order to homogenize the electric field already before the passage through the connecting passages.

The outlet openings may be produced in the front face by means of bores, and have a diameter, or a width, respectively, in the sub-millimeter range up to the millimeter range, preferably of 0.05 mm to 10 mm. As an alternative to pure boreholes, the outlet openings may also comprise separately produced nozzles, which are screwed or inserted into the material of the front face.

The connecting passages may have a round, square, or rectangular cross-section, and may be larger than the outlet openings with regard to their diameter, or their width. In this manner it is to be achieved that the process solution impinges on the substrate surface at a high speed in a targeted manner, and there causes a high material transport in the surface areas to be processed, while a lower flow speed is prevalent in the connecting passages due to the larger diameter. In particular, the pressure prevalent in the connecting passages is also much lower. In borderline cases, the width of a connecting passage may be at an order of magnitude of the substrate dimension. It may also be provided that multiple connecting passages exist at different diameters or widths, wherein in a particularly advantageous manner the diameter, or the width, respectively, on the average is larger than the diameter or the width of the outlet opening.

The flow distribution body may advantageously consist of plastic, in particularly advantageous manner of polypropylene, polyvinyl chloride, polyethylene, acrylic glass, i.e. polymethyl methacrylate, polytetrafluoroethylene, or another material that will not be decomposed by the process solution.

Another advantageous further development provides that the inlet opening is located outside of an incoming and/or outgoing flow zone. With such a spatial separation, there will be no, or only a slight influencing of the incoming process liquid with the incoming or back flow. In this manner any turbulence is also avoided, which would reduce flow distribution speeds, and furthermore in case of an electric field applied, a partial separation of the electric field will be avoided, which is caused by the connecting passages.

A counter electrode body is advantageously attached in the rear region of the flow distribution body, in mechanical contact with, or spatially separated from, the flow distribution body such that the electric current flow is carried out between the counter electrode and the substrate acting as the electrode within the process solution through the connecting passages. Depending on the surface treatment method used, the electrode body may consist of a material that is insoluble in the process liquid, such as platinized titanium, or otherwise a soluble material, such as for example, the metal to be galvanically deposited. Electrode bodies of nearly any shape may be used in the device, which are common with electrolytic surface treatments, such as for example, closed plates, grate-like structures, or metal baskets filled with pellets.

The arrangement of the counter electrode body and of the substrate acting as an electrode on different sides of the flow distribution body has the advantage of enabling a homogenous field line distribution of an electric field caused by both of the above named electrode, corresponding to the arrangement of the surface areas reacting with the process solution. The field distribution is therefore also applied to the substrate surface to be treated in a homogenous manner. Finally, the flow distribution body may be positioned freely between the named electrodes such that the desired reaction on the parts of the substrate surface is substantially influenced by the incoming flow caused by the flow distribution body.

According to the present invention, also a use of a distribution body or a distribution system as described above for a chemical and/or electrolytic surface treatment of a substrate in a process fluid is presented. It is in particular a use of the distribution body or the distribution system for a large substrate with diagonals or diameters in a range of 300 mm and larger, preferably 800 mm and larger, and more preferably 1000 mm and larger.

According to the present invention, also a distribution method for a process fluid for chemical and/or electrolytic surface treatment of a substrate is presented. The distribution method for a process fluid for chemical and/or electrolytic surface treatment of a substrate comprises the following steps:

providing a distribution body as described above, and providing a flow of process fluid from at least an inlet of the distribution body through a flow control array of the distribution body to outlets of the distribution body and towards the substrate.

An optional embodiment of the distribution method is described in the following in more detail.

A flow distribution body having the above mentioned properties and a substrate to be processed are inserted into a process basin filled with the liquid process solution and aligned such that the front face equipped with the outlet openings is positioned plane-parallel to the substrate surface. Small deviations are tolerable.

If the surface treatment is to be carried out with the aid of a voltage applied from the exterior, the substrate is connected to a first electrode such that the electrode and the substrate are positioned on the same potential. A counter electrode body with a polarity that is reversed toward the first electrode, is also incorporated into the process solution in this case, namely into the rear region of the flow distribution body.

The process solution is pumped into the inlet opening, or into multiple of the inlet openings, and exits from the outlet opening, or the outlet openings as an incoming flow at a high speed. Since the outlet openings advantageously have approximately the structure of the structure to be produced on the substrate, the desired reaction will occur particularly at those points of the substrate surface positioned opposite of the outlet openings. The process solution then flows through the connecting passages as a backflow behind the rear face of the flow distribution body, and may be pumped into the cycle in this manner. The flow distribution body and the substrate are thereby freely movable relative to each other such that the incoming flow onto the substrate may be simply and quickly changed by means of a change of the position of the flow distribution body.

In an advantageous further development of the method, the flow distribution body and the substrate may carry out a parallel relative movement toward each other in order to avoid any static liquid flows on the substrate surface. For this purpose either only the flow distribution body, or only the substrate, but of course, also both may be moved in linear stroke-like, circular pivoting or oscillating movements. In this manner the incoming flow of the process liquid is supported by the additional movement, and the dynamics of the incoming flow is maintained by means of the permanent movement of the flow distribution body. Additionally, a relative movement along any desired axes is possible by means of the spatial separation of the substrate and the flow distribution body.

The method may come from the group of the electrolytic or chemical surface treatments, and may comprise, in particular, a galvanic coating, chemical or electrochemical etching, anodal oxidation, or another method of external currentless metal precipitation.

It shall be understood that the system, the device, and the method according to the independent claims have similar and/or identical preferred embodiments, in particular, as defined in the dependent claims. It shall be understood further that a preferred embodiment of the invention can also be any combination of the dependent claims with the respective independent claim.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the accompanying drawing.

DETAILED DESCRIPTION OF EMBODIMENTS

Figure 1:
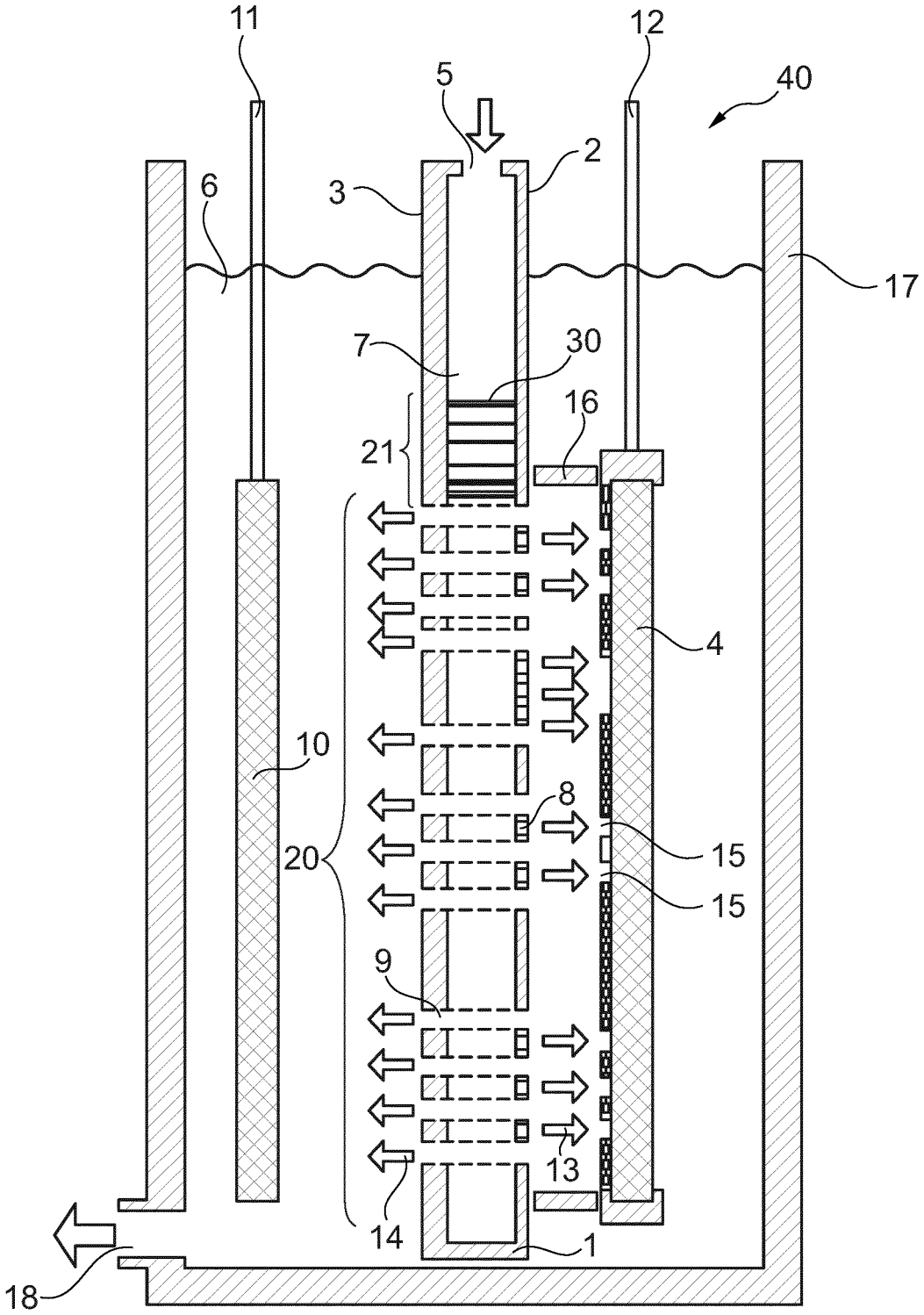
FIG. 1 shows schematically and exemplarily a side view of a cross section of a distribution body and a distribution system for a process fluid for chemical and/or electrolytic surface treatment of a substrate according to the invention.

FIG. 1 shows schematically and exemplarily an embodiment of a distribution body 1 containing several flow control elements 30 for a process fluid 6 for chemical and/or electrolytic surface treatment of a substrate 4 according to the invention. FIG. 1 shows a vertical mount of the distribution body 1 and the substrate 4, while a horizontal arrangement would be also possible.

The (flow) distribution body 1 is submerged in the process fluid 6 or fluidic process solution, which may be aqueous or non-aqueous, in a process basin 17 made from plastic, such as polypropylene. In this process basin 17, there is also the substrate 4 having a conductive surface, which is connected to an electrode 12, as well as a counter electrode body 10, which is connected to a further electrode 11, the polarity of which is opposite of that of the electrode 12. The counter electrode body 10 is embodied as a plate, and has no through-holes. The counter electrode body 10, the substrate 4, and the flow distribution body 1 are spatially separated from each other, wherein a distance between the substrate 4 and the flow distribution body 1 is approximately 20 mm, while the distance between the flow distribution body 1 and the counter electrode 10 is approximately 40 mm. In the present case the substrate 4 is a metal substrate, however, in other exemplary embodiments a semi-conductor substrate, such as a wafer, or a conductor plate, may also be used. In order to apply a structure 15 on partial surfaces of the substrate 4, the substrate 4 was equipped with a suitable marking, which is not or only minutely aggravated by the process solution 6. In this context, "minute" shall mean that although the masking, for example, a photoresist may be ablated by the process solution, this process progresses so slowly, however, that with common process durations a remainder of the masking remains on the substrate 4.

The further electrode 11 is embodied as an anode, while the electrode 12 functions as a cathode. Of course, in other embodiments the further electrode 11 may also represent the cathode, if the electrode 12 is the anode. In the exemplary embodiment illustrated, metal is precipitated on the substrate 4 by means of a galvanic reaction. An electrolytic liquid is used as the process liquid 6. The electric field generated by the two electrodes 11, 12 by means of the arrangement of the counter electrode body 10 and the substrate 4, always extends through the flow distribution body 1. By means of a suitable positioning of the flow distribution body 1 with regard to the counter electrode body 10 and the substrate 4, regions of the substrate 4 may therefore be approached by the electrolytic with a particularly strong incoming flow 13, and also with the electric field such that a reaction occurs at these locations.

The flow distribution body 1 has a front face 2, which is aligned as plane-parallel to the substrate 4 as possible.

A rear face 3 is positioned opposite of the front face 2. A hollow space, the liquid passage 7, is present between the front face and the rear face, which may be filled with the process solution 6. For this purpose an inlet 5 or inlet opening is located in a lateral area of the flow distribution body 1 located between the front face 2 and the rear face 1, which is equipped with a thread for the connection to the casing of the pump cycle. The flow distribution body 1 itself is made from polypropylene.

The convection chamber formed by the front face 2 and the surface of the substrate 4 is further limited by means of the walls of the process basin 17 and a further wall 16, which forces a targeted backflow 14 through the connecting passages 9, and simultaneously influences the field line distribution of the electric current favorably. In the exemplary embodiment shown, these walls are also made of polypropylene. Just as the further wall 16 is arranged between the substrate 4 and the front face 2, such wall may, of course, also be arranged between the rear face 3 and the counter electrode body 10. In the example shown, the further wall 16, like the process basin 17, is made of a plastic, such as polypropylene.

Bore holes with a diameter of 1 mm are contained in the flow distribution body 1, which end in outlets 8 or outlet openings of the liquid passage 7, each with an identical diameter at the front face 2. In addition to cylindrical shapes, the bore holes may also have a conical shape. The distribution of the outlet openings 8 approximately corresponds with the structure 15 to be produced on the substrate 4, i.e. the outlet openings 8 are in alignment with those partial surfaces of the substrate 4, on which the structure 15 is to be displayed. In this manner the incoming flow 13 coming from the outlet openings 8 impinges directly upon those partial surfaces of the substrate 4, which are to participate in the electrochemical reaction. The outlet openings 8 are round, but may also be embodied in an elliptical or rectangular shape, or in other geometric shape, as long as an adequate flow speed may be reached. The outlet openings 8 may also be significantly larger in a spatial dimension than in another such that, for example, a line-shaped or column-shaped geometry is achieved, wherein the lines or columns may extend across the entire length, or width, respectively, of the flow distribution body 1.

The process solution 6 exits the hollow space positioned between the front face 2 and the rear face 3 through the outlet openings 8 at a high flow speed, and forms an incoming flow 13 directed toward the substrate 4. The metal coating occurs in the local surface areas at the structure 15 to be applied, and the direction of the flow reverses at that point. Due to the now less strongly directed flow, the flow speed is reduced, the backflow 14 formed is guided to the rear face 3 of the flow distribution body 1 through the connecting passages 9. The connecting passages 9 are located adjacent to the outlet openings 8, and thereby form the structure 15 to be produced on the substrate 4, also offset by approximately about 2 mm as opposed to the surfaces of the structure 15. In the exemplary embodiment shown the connecting passages 9 are individual tubes that were used in the corresponding openings of the flow distribution body 1.

The connecting passages 9 have a diameter of 5 mm. Due to the different size relations of the connecting passages 9 and the outlet openings 8, the liquid pressure and the flow speed are much lower in the connecting passages 9. The process solution 6, having reached the rear face 3 of the flow distribution body 1, is re-pumped into the inlet opening 5 by means of a drain 18 of the process basin 17 and a pump (not illustrated).

In order to avoid any rigid flow vectors, and instead achieving a convection of the reacting surface areas of the substrate 4 that are as even as possible, the flow distribution body 1 and the substrate 4 are in a relative movement parallel to each other from up to 1 mm in both directions, wherein in the present case both bodies are moved parallel to the incoming flow 13, or the backflow 14, respectively.

According to the present invention, a distribution system 40 for chemical and/or electrolytic surface treatment of a substrate 4 in a process fluid 6 is presented. The distribution system 40 comprises a distribution body 1 and a substrate holder (not shown). The substrate holder is configured to hold at least one substrate 4 relative to an outlet array 20 of the distribution body 1.

According to the present invention, the distribution body 1 comprises a front face 2, a rear face 3, at least an inlet 5, an outlet array 20, and a flow control array 21. The front face 2 is directed towards the substrate 4 for the surface treatment of the substrate 4. The rear face 3 is arranged opposite to the front face 2.

The inlet 5 is an entry of the process fluid 6 into the distribution body 1. The outlet array 20 comprises several outlets 8, which are an exit of the process fluid 6 out of the distribution body 1 and towards the substrate 4. The flow control array 21 is arranged upstream of the outlet array 20 with respect to a flow of the process fluid 6 and comprises several flow control elements 30.

The arrangement of several flow control elements 30 upstream of the outlet array 20 allows equilibrating the flow of electrolyte towards the jet holes. A uniform distribution of the liquid flow within the HSP in horizontal and vertical direction is obtained. The uniform flow distribution leads to a uniform plating process and plating result on the substrate 4 without reducing the overall flow speed of the electrolyte.

Preferably, the distribution body 1 comprises exactly or at least two different kinds of flow control elements 30, which means flow control elements 30, which differ in view of their (cross sectional) size, shape and/or distance. More preferably, the distribution body 1 comprises two different kinds of flow control elements 30, which differ in view of their (cross sectional) size, which means a group of larger flow control elements 30 and a group of smaller flow control elements 30. The larger flow control elements 30 are arranged closer to the inlet 5, the smaller flow control elements 30 are arranged closer to the outlet array 20 for the process fluid 6.

The arrangement of several flow control elements 30 upstream of the outlet array 20 in particular equilibrates the flow of electrolyte towards the jet holes by eliminating laminar flow areas. The flow control elements 30 are therefore arranged in a pattern to achieve a turbulent flow of the process fluid 6 towards the outlet array 20. In particular, the flow control elements 30 are arranged in a pattern to achieve Reynolds numbers of at least 5000 in the process fluid 6.

The pattern can comprise (when seen in a flow direction of the fluid) a first row of flow control elements 30 of a first size, first shape and/or arranged with a first distance relative to each other and at least a second row of flow control elements 30 of a second size, second shape and/or arranged with a second distance relative to each other. The row extends perpendicular to the flow direction of the fluid and comprises several flow control elements 30 of the same kind (size, shape and/or distance) when seen in the fluid flow direction. The first size and/or distance may be larger than the second size and/or distance. Adjacent flow control members are displaced relative to each other and not aligned with each other.

Figure 2:
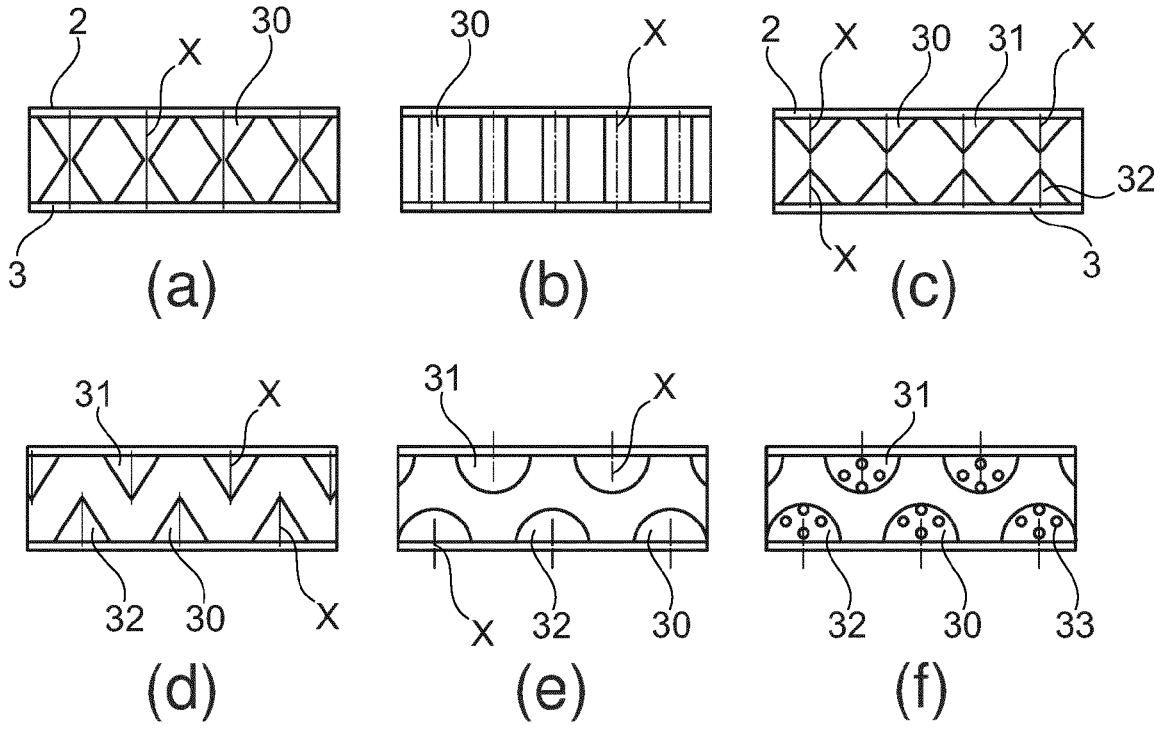
FIGS. 2*a* to 2*f* show schematically and exemplarily flow control arrays with flow control elements according to the invention.

FIGS. 2*a* to 2*f* show side views or cross sectional views of flow control elements 30. As shown in FIG. 2*a*, at least some of the flow control elements 30 have a cross-section of varying size along the length of the flow control elements 30. The longitudinal cross section is in shape of a double cone.

As shown in FIG. 2*b*, at least some of the flow control elements 30 have a constant cross-section along their length and are continuous (when seen in a cross section of the distribution body 1), the latter means they extend between the front face 2 and the rear face 3 and are in contact with the front face 2 and the rear face 3. They are pillar or rod shaped.

As shown in FIGS. 2*c* to 2*f*, at least some of the flow control elements 30 are discontinuous and in contact with the front face 2 and the rear face 3, but do not extend between the front face 2 and the rear face 3. They comprise a first component 31 arranged at the front face 2 and a second component 32 arranged at the rear face 3, while the first and the second components 31, 32 are separate from each other and do not meet or contact each other. The first and the second components 31, 32 are shaped as triangles or hemispheres. The first and the second components 31, 32 and in particular their central axes X can be directed towards another and are aligned with each other (see FIG. 2*c*). The first and the second components and in particular their central axes X can also be displaced relative to each other (see FIGS. 2*d* to 2*f*).

As shown in FIGS. 2*a* to 2*e*, at least some of the flow control elements 30 are massive. As shown in FIG. 2*f*, at least some of the flow control elements 30 comprise through holes 33 to allow a flow of fluid through the flow control elements 30. In other words, the flow control elements 30 are not fully massive.

Figure 3:
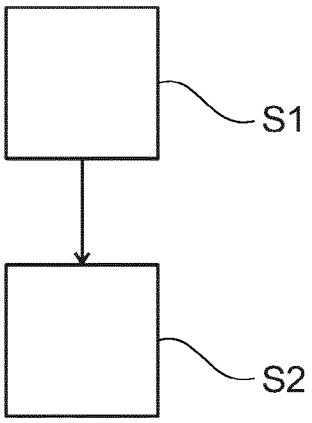
FIG. 3 shows schematically and exemplarily a distribution method for a process fluid for chemical and/or electrolytic surface treatment of a substrate according to the invention.

As shown in FIG. 3, also a distribution method for a process fluid 6 for chemical and/or electrolytic surface treatment of a substrate 4 is presented. The distribution method for a process fluid 6 for chemical and/or electrolytic surface treatment of a substrate 4 comprises the following steps:

Step 1. providing a distribution body 1 as described above, and

Step 2. providing a flow of process fluid 6 from at least an inlet 5 of the distribution body 1 through a flow control array 21 of the distribution body 1 to outlets 8 of the distribution body 1 and towards the substrate 4.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A distribution body for a process fluid for chemical and/or electrolytic surface treatment of a substrate, comprising:

a front face, a rear face, at least an inlet, an outlet array, a flow control array, and at least one connecting passage, wherein the front face is configured to be directed towards the substrate for the surface treatment of the substrate, wherein the rear face is arranged opposite to the front face, wherein the inlet is configured for an entry of the process fluid into the distribution body, wherein the outlet array comprises several outlets, which are configured for an exit of the process fluid out of the distribution body and towards the substrate, wherein the flow control array is arranged upstream of the outlet array with respect to a flow of the process fluid, wherein the flow control array comprises several flow control elements arranged to equilibrate the flow of the process fluid towards the outlets, and wherein the flow control array is arranged adjacent to one of the at least one connecting passage.

2. The distribution body according to claim 1, wherein the flow control elements are arranged in a pattern to achieve a turbulent flow of the process fluid towards the outlet array.

3. The distribution body according to claim 1, wherein the flow control elements are arranged in a pattern to achieve Reynolds numbers of at least 5000 in the process fluid.

4. The distribution body according to claim 1, wherein at least some of the flow control elements extend between the front face and the rear face and are in contact with the front face and the rear face.

5. The distribution body according to claim 1, wherein at least some of the flow control elements are pillar shaped.

6. The distribution body according to claim 1, wherein at least some of the flow control elements extend between the front face and the rear face and are only in contact with one of the front face or the rear face.

7. The distribution body according to claim 1, wherein at least some of the flow control elements are shaped as stalactites or stalagmites.

8. The distribution body according to claim 1, wherein at least some of the flow control elements have a constant cross-section along their length.

9. The distribution body according to claim 1, wherein at least some of the flow control elements have a cross-section of varying size along the length of the flow control elements.

10. The distribution body according to claim 1, wherein at least some of the several flow control elements are arranged with different distances to each other.

11. The distribution body according to claim 1, wherein a fixed build size of the distribution body is in a range of 1 and 10 cm.

12. The distribution body according to claim 1, wherein at least some of the flow control elements have a patterned surface.

13. The distribution body according to claim 12, wherein the patterned surface comprises a golf ball kind of surface.

14. The distribution body according to claim 1, wherein at least some of the several flow control elements have different sizes.

15. The distribution body according to claim 14, wherein at least some of the several flow control elements have different diameters relative to each other.

16. A distribution system for chemical and/or electrolytic surface treatment of a substrate in a process fluid, comprising:

the distribution body according to claim 1, and a substrate holder, wherein the substrate holder is configured to hold at least one substrate relative to an outlet array of the distribution body.

17. A distribution method for a process fluid for chemical and/or electrolytic surface treatment of a substrate, comprising:

providing the distribution body according to claim 1, and providing a flow of process fluid from at least an inlet of the distribution body through a flow control array of the distribution body to outlets of the distribution body and towards the substrate.

18. A method of using the distribution body according to claim 1 for a chemical and/or electrolytic surface treatment of a substrate in a process fluid.

19. The method of claim 18, wherein the surface is from a large substrate with diagonals or diameters in a range of 300 mm and larger.

20. The method of claim 19, wherein the diagonals or diameters are in a range of 800 mm and larger.

21. The method of claim 19, wherein the diagonals or diameters are in a range of 1000 mm and larger.

* * * * *